US005115917A

United States Patent [19]

Schrage

[11] Patent Number: 5,115,917

[45] Date of Patent: May 26, 1992

[54] CORNER SUPPORT ASSEMBLY

[76] Inventor: David A. Schrage, 27614 Parkview, Apt. 304, Warren, Mich. 48092

[21] Appl. No.: 726,754

[22] Filed: Jul. 8, 1991

[51] Int. Cl.[5] ..... B65D 81/02

[52] U.S. Cl. ..... 206/586; 108/55.1

[58] Field of Search ..... 108/55.1; 206/320, 386, 206/453, 586, 597; 229/23 R, DIG. 1

[56] References Cited

U.S. PATENT DOCUMENTS

| | | | |
|---|---|---|---|
| 1,200,467 | 10/1916 | Cady | 206/453 |
| 2,920,809 | 1/1960 | Bray | 206/320 |
| 3,405,665 | 10/1968 | Slonim | 108/55.1 |
| 3,433,354 | 3/1969 | Liebel . | |
| 3,533,502 | 10/1970 | Hansen | 206/453 |
| 3,980,221 | 9/1976 | Okada . | |
| 4,265,184 | 5/1981 | Cox . | |
| 4,292,901 | 10/1981 | Cox . | |
| 4,553,484 | 11/1985 | Cox | 108/55.1 |
| 4,714,163 | 12/1987 | Reeves . | |
| 4,771,893 | 9/1988 | Liebel . | |
| 4,865,201 | 9/1989 | Liebel . | |

*Primary Examiner*—Jimmy G. Foster
*Attorney, Agent, or Firm*—Brooks & Kushman

[57] ABSTRACT

A corner support assembly for strengthening a corner of a container so that additional containers may be stacked on top thereof, is provided. The corner support assembly has first and second elongated members having cooperating attachment means so that the length of assembly can be adjusted commensurately with the length of the edge associated with the corner to be supported. Also included is an anchoring means for releasably attaching one of the members to an associated edge of the container such that the corner support assembly remains in juxtaposition with the edge of the container. Preferably, the anchoring means is a hook that affixes over a free edge of the container.

13 Claims, 1 Drawing Sheet

CORNER SUPPORT ASSEMBLY

TECHNICAL FIELD

This invention relates generally to the art of packaging, and in particular, to corner supports for use in containers.

BACKGROUND ART

Containers for storing or transporting articles therewithin are typically stacked one on top of another in order to reduce the horizontal space they occupy. Often, these containers are made of cardboard or the like which, while inexpensive to produce, do not provide significant structural strength against crushing. Accordingly, various means of providing reinforcement to stacked containers have been devised.

Column members have been inserted along the vertical inside edges or corners of containers to provide support. These column members may be placed along each of the vertical edges, or alternatively, at two opposing diagonal corners. Also, pressed cardboard or chip-board column members, configured to a 90° angle and placed juxtaposed adjoining sides of a container, are used. Such reinforcements, however, are not adjustable in length and are usually discarded after use, since they are not readily redeployed.

A variety of U.S. patents disclose corner support members which are used as protective packaging and/or column members.

Liebel, U.S. Pat. Nos. 4,865,201 and 4,771,893, disclose laminated paperboard members with a core of corrugated paper for cushioning the outside of corners and straight edges of packaged articles along their full height. The corner posts are of a fixed length and do not secure to a container.

Cox, U.S. Pat. Nos. 4,292,901 and 4,265,184, disclose cornerboards for pallets which are adjustable in length. One embodiment comprises two L-shaped sections with complementary tongues and slots forming a connection therebetween. A second embodiment has a variety of interlocking sections and spacer members. The cornerboards are placed along each of four edges on the outside of a pallet, and are juxtaposed about the corners for support thereof. One or more flexible straps encircle the cornerboards to provide the necessary circumferential support. There is no teaching of affixing the cornerboards to a container holding articles therewith.

Reeves, U.S. Pat. No. 4,714,163, teaches an edge protector made of multi-ply fiberboard construction having a right angle cross-section. Adhesive pads facing inwardly removably secure the edge protector to a product to be protected. No suggestion is offered that the protector provides vertical support to the container such that other products or containers may be stacked atop the protector or that the protector attach to a container. Again, the protector is of a fixed length.

Okada, U.S. Pat. No. 3,980,221, shows a package cushioning structure for use in containers to protect edges and corners of articles against shock and damage from lateral impact.

Liebel, U.S. Pat. No. 3,433,354, discloses a resilient angle member for use in packaging to provide stacking strength, act as a spacer between the container and articles being shipped and serve as a shock absorber. The angle member is of a fixed length and does not secure to a container.

The above corner support members exhibit several disadvantages. When using either wood columns, angled cardboard or the like, pieces must be cut to a height corresponding to the container. Unless the support members are pre-cut in an automated process, a person cutting the support member to size may injure him-or herself. Also, with wood support members, splinters are often received into the hands of personnel handling the support members.

A second problem is that the support members are generally of a fixed length. Therefore, if a container of different height is used, a previously used support member must be cut shorter, if possible, or else a new, longer support member must be obtained. Typically, the used support member which is too short or the remnant of a cut support member will be discarded. Ideally, corner supports should be reusable to reduce cost and waste.

A third problem is that the support members lack retention means to maintain the support members in the corners of a container. As a result, the support member may interfere with the filling or emptying of the contents of the container, thereby increasing the time and expense needed to accomplish this task. Alternatively, the packaging material may dislodge the support member from this associated corner, thereby eliminating its reinforcing role.

The corner support assembly of the present invention is designed to overcome the shortcomings of the above references.

DISCLOSURE OF THE INVENTION

The present invention is a reusable corner support assembly for strengthening an edge or corner of a container against crushing or buckling under imposed loading. The assembly is comprised of first and second members, each having corner-engaging and overlapping ends. The assembly is provided with an attachment means for releasably securing the overlapping ends of the first and second members in relationship to each other so that the length of the assembly can be adjusted commensurately with the length of an associated edge to be supported. Also preferably included in the present invention is an anchoring means for releasably attaching one of the members to the associated edge of the container, thereby retaining the corner support assembly in juxtaposition therewith. Preferably, each member of the corner support assembly is L-shaped in cross-section, thereby forming a pair of flanges, each flange being juxtaposed with a wall of the container.

Ideally, the attachment means includes a plurality of projections and apertures, located along the flanges, wherein the projections on one member cooperatively and releasably engage with the apertures on the other member to enable the length of the assembly to be varied corresponding to the dimensions of the associated edge of a container. The projections and apertures may be engageable in a snap-fit relation.

The anchoring means is preferably detachably connected along the associated edge so as not to become dislodged and fall into the interior of the container, thereby interfering with the filling or emptying of the container. The anchoring means may be a hook fixedly attached to the corner-engaging end of a member and which extends outwardly from inside of the L-shaped cross-section of a member and medially towards its overlapping end, thereby being attachable over a free edge of the container. The corner-engaging ends of the corner support assembly may also include end plates, fixedly secured to the flanges, providing a bearing area so that other containers may be stacked thereabout.

It is an object of the present invention to provide corner support assemblies for containers such that the buckling strength of the edges is enhanced, thereby allowing containers to be stacked on top of one another without container distortion or damage to the contents thereof.

Another object is to provide a corner support assembly that is adjustable in length commensurate with the length of an associated edge to be supported.

A further object is to provide an anchoring means whereby the corner support assembly is releasably secured to the container such the support assembly does not become dislodged and interfere with the filling or emptying of the container.

Yet another object is provide a corner support assembly that is inexpensive to make, lightweight, and reusable.

Other advantages and objects of the present invention will become more readily apparent from the following description.

BEST MODE FOR CARRYING OUT THE INVENTION

Figure 1:
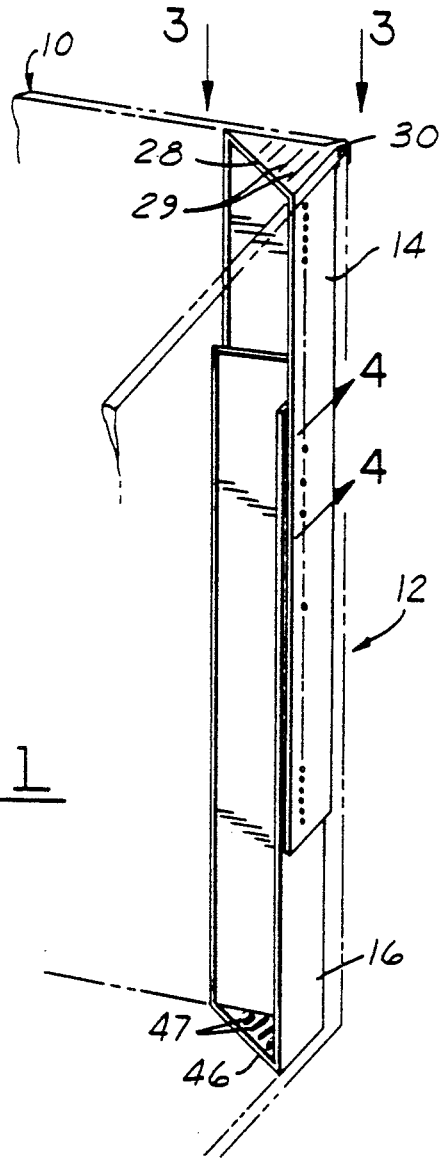
FIG. 1 is a perspective view of a corner support assembly made in accordance with the present invention, located in juxtaposed relation to an associated edge of a container to be strengthened and releasably secured to a free corner, the container being shown in phantom lines.

As seen in FIG. 1, along the edge or corner of a container 10 is a corner support assembly 12 made in accordance with the present invention. The corner support assembly 12 comprises an elongated first member 14 and an elongated second member 16. The first and second members 14 and 16 are both preferably L-shaped in cross-section and are adjustably interconnected such that the length of the assembly can be adjusted commensurately with the length of the associated edge of the container to be supported.

Other cross-sectional profiles, such as circular or semi-circular, could also be utilized. Preferably, first and second members 14 and 16 are injection molded and made from thermoplastics which are preferably high-strength, lightweight, ductile, recyclable, and inexpensive. If a corner support assembly 12 of greater strength is required, it may be of metal fabrication or produced from other materials of higher strength.

Figure 2:
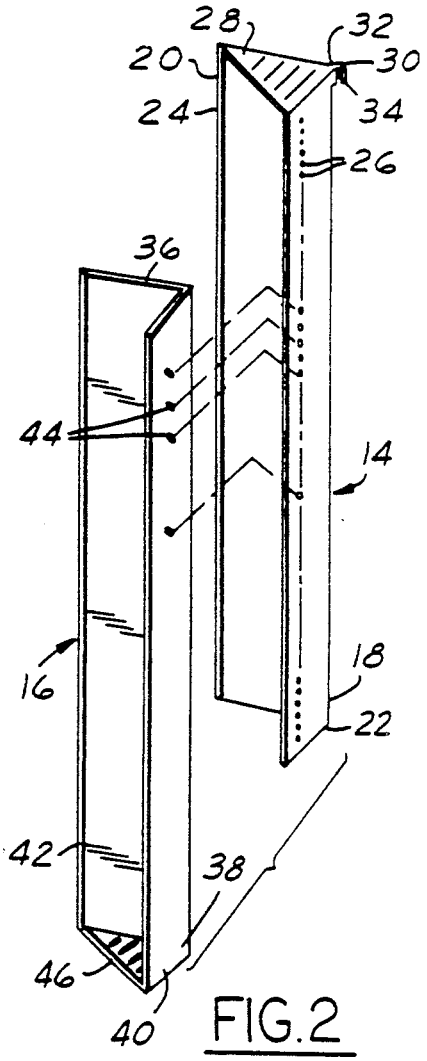
FIG. 2 is an exploded perspective view of first and second members which releasably secure together to form the corner support assembly.

As best seen in FIG. 2, the first member 14 has a overlapping end 18 and a corner-engaging end 20. The L-shaped cross-section is comprised of a first flange 22 and a second flange 24. The first flange 22 has a plurality of spaced apertures 26. The apertures are preferably 0.150" in diameter and located ¼" on center.

Atop the corner-engaging end 20 of the first member 14 is a triangular shaped bearing plate 28 which is fixedly secured to first and second flanges 22 and 24. Ridges 29 extend longitudinally along the outer surface of bearing plate 28 and provide for frictional engagement with container 10 to help prevent sliding therebetween.

Figure 3:
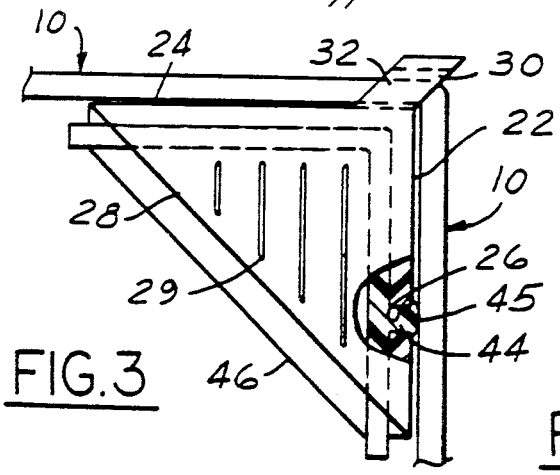
FIG. 3 is an enlarged partial top view, as seen from the direction of arrows 3—3 of FIG. 1, showing a hook securing about a free edge of the container and in a cut-away view, a projection of the second member locating in a snap-fit relation with an aperture on the first member.

A hook 30, fixedly secured to the corner-engaging end 20, includes an outwardly extending lateral portion 32 and a medially extending vertical portion 34. The hook 30 is sized to fit about a free upper edge of container 10. As best seen in FIG. 3, the lateral portion 32 extends outwardly at approximately a 45° angle relative to flanges 22 and 24 and extends over the corner of container 10. This allows flaps, which are typically located along the top edge of a container and used to close the top of the container, (not shown) to be folded over in the usual overlapping manner.

It is also within the scope of this invention to use other anchoring means to secure corner support assembly 12 to container 10. These means might include a pin extending through the container 10 with fastening means on the outside thereof or other like means of securement.

Looking again to FIG. 2, second member 16 has a overlapping end 36 and a corner-engaging end 38. The L-shaped cross-section of second member 16 includes first flange 40 and a second flange 42. First flange 40 has a plurality of outwardly extending round projections 44 sized and spaced to cooperatively engage with apertures 26 of first member 14 in a press-fit relation. Preferably the projections 44 are located ¼" on centers. Projections 44 have an enlarged end 45, which are approximately 0.002" oversized relative to apertures 26. The projections 44 may also be of other than circular cross-sections. At the corner-engaging end 38 is a triangular-shaped bearing plate 46 which extends perpendicular, and fixedly secures, to first and second flanges 40 and 42.

It is contemplated that other configurations of interconnecting projections and apertures could also be used. Both flanges on the first and second members 14 and 16 could have cooperating apertures and projections. Alternatively, additional rows of apertures and projections could be placed on the flanges. Also, other configurations of releasably securable connections could be used such as tongue and groove connections or the like. An advantage to using the snap-fit or press-fit projection-aperture connection, as described above, is that with the apertures 26 spaced ¼" on centers, the corner support assembly 12 may be adjusted in length by ¼" increments. Other types of connections may not allow apertures to be as closely spaced or as easily assembled and disassembled. The container 10 provides lateral support to corner support assembly 12 to prevent it from buckling outward and the projections 44 from disengaging apertures 26.

Figure 4:
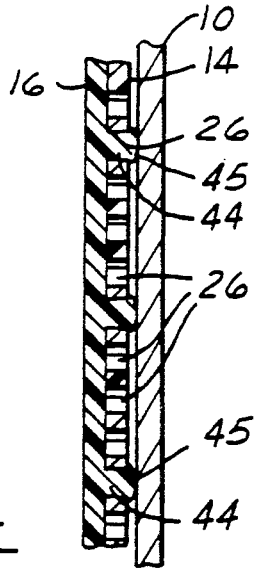
FIG. 4 is an enlarged fragmentary sectional view, taken along line 4—4 of FIG. 1, showing a plurality of projections locating within apertures.

In operation, the first and second members 14 and 16 are placed within container 10 with bearing plate 46 of second member 16 resting upon the floor of container 10 and hook 30 of first member 14 extending over the free edge of container 10. The first member 14 is translated longitudinally relative to the second member 16 until projections 44 are aligned with corresponding apertures 26. Projections 44 are then pressed into apertures 26 thereby creating a snap-fit connection, as seen in FIG. 4, such that the length of the corner support assembly 12 is commensurate with the length of associated edge to be strengthened. This procedure is repeated at each of the remaining edges or corners of the container. If the container has flaps (not shown) along its upper edges, the flaps may be closed in the ordinary overlapping fashion with the lateral portions 32 of hooks 30 extending through the gaps located between the ends of the flaps.

Other containers may then be stacked atop of the first container 10 having corner support assemblies 12. Alternately, the corner support could be horizontally aligned to provide additional horizontal load bearing capacity. In this case, a second hook (not shown), comparable to hook 30, could be located at the corner-engaging end 38 of second member 16 to provide securement to another free edge of the container. Also, it is contemplated that other anchoring means could be used to releasably secure corner support assembly 12 to container 10.

Because each of the corner support assemblies 12 is releasably affixed to container 10 by a hook 30, contents may be loaded into and unloaded from container 10 without the corner support assembly 12 falling into the container and causing interference with loading and unloading procedure.

When the container 10 is emptied, the corner support assemblies 12 may be removed with the first and second members 14 and 16 being separated such that they may be readjustably reconnected to fit a container of a different height or dimension. Therefore, the corner support assembly 12 may be reused rather than disposed.

Thus, there has been disclosed a corner support assembly which is adjustable in length to accommodate the requirements of containers of different dimensions. The corner support assembly has anchoring means which prevents the assembly from dislodging from its corner position and interfering with the filling and emptying of the container. Because the corner support assemblies are adjustable and reusable, they are inexpensive to use and limit waste as is typical of other corner supports.

Preferably, the corner support assemblies 12 are made of plastic which may be ground up and recycled when they are finally disposed. When first and second members 14 and 16 are being molded, indicia may be formed thereupon to indicate the type of plastic from which they are being made.

While in the foregoing specification this invention has been described in relation to certain preferred embodiments thereof, and many details have been set forth for the purpose of illustration, it will be apparent to those skilled in the art that the invention is susceptible to alteration and that certain other details described herein can vary considerably without departing from the basic principles of the invention.

What is claimed:

1. A corner support assembly for strengthening associated corners of a container, comprising:

an elongated first member having corner-engaging and overlapping ends;

an elongated second member having corner-engaging and overlapping ends, the overlapping end thereof being adapted to be securable to the first member;

attachment means for releasably securing the overlapping ends of the first and second members to each other so that the length of the assembly can be adjusted commensurately with the length of the edge to be supported, whereby adjustment of the attachment means provides extension or retraction of the members in relation to each other through a secured overlapping relationship;

anchoring means for releasably attaching one of the members within the associated edge of the container, thereby retaining the corner support assembly in juxtaposition therewith, so that the container may support others resting thereupon, the corner support assembly primarily carrying the load associated therewith.

2. The corner support assembly of claim 1, wherein the container has a plurality of vertical edges, and a corner support assembly is provided for at least one of the vertical edges.

3. The corner support assembly of claim 2 wherein the container has 4 vertical edges.

4. The corner support assembly of claim 3 wherein each of the vertical edges has a corner support assembly.

5. The corner support assembly of claim 1 wherein each member is L-shaped in cross-section, thereby forming a pair of flanges, each flange being juxtaposed with a wall of the container.

6. The corner support assembly of claim 5 wherein the attachment means includes a plurality of projections and apertures located along the flanges, wherein the projections are cooperatively engageable with the apertures, thereby enabling the length of the assembly to be adjusted in accordance with the dimensions of the associated edge.

7. The corner support assembly of claim 6 wherein the projections and apertures are engageable in a snap-fit relation.

8. The corner support assembly of claim 1 wherein the anchoring means is detachably connected to a corner of the container.

9. The corner support assembly of claim 8 wherein the anchoring means is a hook.

10. The corner support assembly of claim 9 wherein the anchoring means extends outwardly from the L-shaped cross-section of a member and medially from the corner-engagement end thereof towards the overlapping end thereof.

11. The corner support assembly of claim 1 wherein at least one of the corner-engaging ends has a fixedly attached end plate extending perpendicular to the longitudinal axis of the corner support assembly, the end plate providing a bearing area so that other containers may be supported thereby.

12. The corner support assembly of claim 11 wherein the end plate is fixedly secured across both flanges.

13. The corner support assembly of claim 1 wherein the first and second members are made of a recyclable plastic.

* * * * *